US007021225B2

(12) United States Patent
Imaeda

(10) Patent No.: US 7,021,225 B2
(45) Date of Patent: Apr. 4, 2006

(54) HANDLE MOUNTING STRUCTURE FOR SEWING MACHINE AND HANDLE MOUNTING STRUCTURE FOR CASING

(75) Inventor: Toru Imaeda, Ichinomiya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/982,805

(22) Filed: Nov. 8, 2004

(65) Prior Publication Data

US 2005/0166815 A1 Aug. 4, 2005

(30) Foreign Application Priority Data

Feb. 3, 2004 (JP) ..... 2004-026654

(51) Int. Cl.
*D05B 73/00* (2006.01)

(52) U.S. Cl. ..... 112/258

(58) Field of Classification Search ..... 112/258–260, 112/217.1, 217.2; 49/460; 190/115; 16/110.1, 16/408–410, 418, 223
See application file for complete search history.

(56) References Cited

U.S. PATENT DOCUMENTS

| | | | | |
|---|---|---|---|---|
| 2,900,941 | A * | 8/1959 | Platt | 112/270 |
| 4,658,467 | A * | 4/1987 | Stolarz | 16/114.1 |
| 4,936,234 | A * | 6/1990 | Jimenez et al. | 112/259 |
| 6,152,317 | A * | 11/2000 | Newby, Sr. | 220/4.22 |
| 6,398,033 | B1 * | 6/2002 | Wu et al. | 206/711 |
| 6,814,017 | B1 * | 11/2004 | Sakakibara et al. | 112/258 |

FOREIGN PATENT DOCUMENTS

| | | |
|---|---|---|
| JP | Y2 61-1896 | 1/1986 |
| JP | Y2 5-15917 | 4/1993 |

* cited by examiner

*Primary Examiner*—Ismael Izaguirre
(74) *Attorney, Agent, or Firm*—Oliff & Berridge, PLC

(57) ABSTRACT

A handle mounting structure for a sewing machine includes a handle including a grip having both ends provided with a pair of legs having distal ends respectively, two pairs of shaft-like members mounted on the distal ends of the legs, a pair of pivots mounted on either front cover or rear cover for supporting the legs respectively, the pivots having engagement holes either corresponding one of the paired shaft-like members of each leg engages, the handle being slid in a projecting direction of said one shaft-like member before said one of the front and rear covers is mounted to the other of the front and rear covers so that said one shaft-like member is engageable with the engagement hole.

30 Claims, 8 Drawing Sheets

HANDLE MOUNTING STRUCTURE FOR SEWING MACHINE AND HANDLE MOUNTING STRUCTURE FOR CASING

BACKGROUND OF THE INVENTION

1. Field of the Invention

This invention relates to a handle mounting structure for mounting, on a sewing machine cover, a handle used for carrying a portable sewing machine and a handle mounting structure for mounting, on a casing comprising two cover members combined with each other, a handle.

2. Description of the Related Art

Small portable sewing machines such as household lock stitch machines or embroidering machines have conventionally been provided with handles (grips) rotatably mounted on body covers. An operator holds the handle with his or her hand when carrying the sewing machine.

The handle is mounted on the body cover in a manufacturing step of the sewing machine in the following manner. The handle includes a pair of legs. The legs have distal ends formed with engagement pins respectively. The body cover of the sewing machine includes a front cover and a rear cover. The front and rear covers have upper ends formed with a pair of engagement depressions corresponding to the engagement pins respectively. Before assembling the front and rear covers to the body cover, the operator inserts either engagement pin into the corresponding depression of the front or rear cover. While holding the handle so that the pin is prevented from disengaging the depression, the operator fixes the front and rear covers to each other by screws. Thus, the handle is assembled onto the front and rear covers.

However, the work of fixing both covers with the handle being held has low workability and is time-consuming. Furthermore, the handle easily detaches when just assembled onto the cover. Accordingly, there is a possibility that the handle may detach from the covers unless it is held during assembly.

In view of the foregoing problem, various handle mounting structures have been proposed for preventing the handle from being detached from the body cover and improving a handle assembling efficiency. For example, JP-Y-61-1896 discloses a handle support comprising a support arm serving as a handle supporting portion and support fittings both fixed to suitable members within a sewing machine arm. Both support arm and support fittings have respective engagement apertures. On the other hand, a handle has a pair of legs further having respective distal ends. Engagement protrusions are formed integrally on outer faces of the distal ends of the legs respectively so as to correspond to engagement apertures of the support arm and fittings.

The paired legs of the handle are elastically deformed inward so that the engagement protrusions are inserted into the engagement apertures of the support fittings and support arm. Subsequently, each leg is recovered to the former state such that the engagement protrusions are prevented from disengagement from the engagement apertures and accordingly, the hand is prevented from easy detachment from the sewing machine body.

Furthermore, for example, JP-Y-5-15917 discloses another handle mounting structure. More specifically, a pair of left and right grooves are formed in an upper side of a sewing machine frame, and a pair of chambers adjacent to the grooves with walls interposed therebetween respectively are also formed in the upper side of the sewing machine. The handle includes a pair of legs provided with respective support shafts. A Stopping member with fins is fitted with each support shaft. The fins are thrust into the respective chambers so that the handle is mounted in the grooves. In this case, the handle is prevented from detaching from the grooves by the stopping members.

In the foregoing handle support and handle mounting structure, extra components such as the support fittings, support arm, stopping members with respective fins and the like are required in order that the handle may be mounted on the sewing machine arm. The assembling efficiency is reduced since the extra components need to be assembled into every sewing machine. Furthermore, the extra components increase the production cost of the sewing machine.

SUMMARY OF THE INVENTION

Therefore, an object of the present invention is to provide a handle mounting structure for a sewing machine in which the number of components required for mounting the handle on the sewing machine cover can be reduced into as a small number as possible, and yet, the handle can be prevented from an easy disengagement from the sewing machine cover.

The present invention provides a handle mounting structure for a sewing machine including a sewing machine body, a front cover covering the sewing machine body and a rear cover. The structure comprises a handle including a grip having both ends provided with a pair of legs having distal ends respectively, two pairs of shaft-like members provided on the distal ends of the legs, and a pair of pivots provided on either front cover or rear cover for supporting the legs respectively, the pivots having engagement holes either corresponding one of the paired shaft-like members of each leg engages, the handle being slid in a projecting direction of said one shaft-like member before said one of the front and rear covers is mounted to the other of the front and rear covers so that said one shaft-like member is engageable with the engagement hole.

In the above-described construction, no extra components are used when the handle is mounted on the sewing machine. Consequently, the number of components can be reduced. Furthermore, both front and rear covers are assembled to the sewing machine body while the handle is mounted on either front or rear cover. Consequently, an assembling work can be simplified. Additionally, since the pivots of the handle are provided on either front or rear cover, the handle can be prevented from being removed from the sewing machine cover.

In one embodiment, said one shaft-like member is engageable with and disengageable from the engagement hole only when the handle is in a predetermined position. Furthermore, the legs abut against said other cover when said other cover has been mounted on said one cover, whereby a turn of the handle toward said other cover over a limit position is limited.

In the above-described construction, the handle is prevented from falling off from said one cover when the handle assumes a position other than the predetermined position after the shaft-like member has been engaged with the engagement hole. Consequently, the work of assembling the covers together can further be simplified. Furthermore, one shaft-like member is prevented from falling off from the engagement hole when one of the covers has been mounted on the other cover. Consequently, the handle can be mounted on the sewing machine cover reliably.

BRIEF DESCRIPTION OF THE DRAWINGS

Other objects, features and advantages of the present invention will become clear upon reviewing the following description of embodiments with reference to the accompanying drawings, in which.

DETAILED DESCRIPTION OF THE INVENTION

Figure 1:
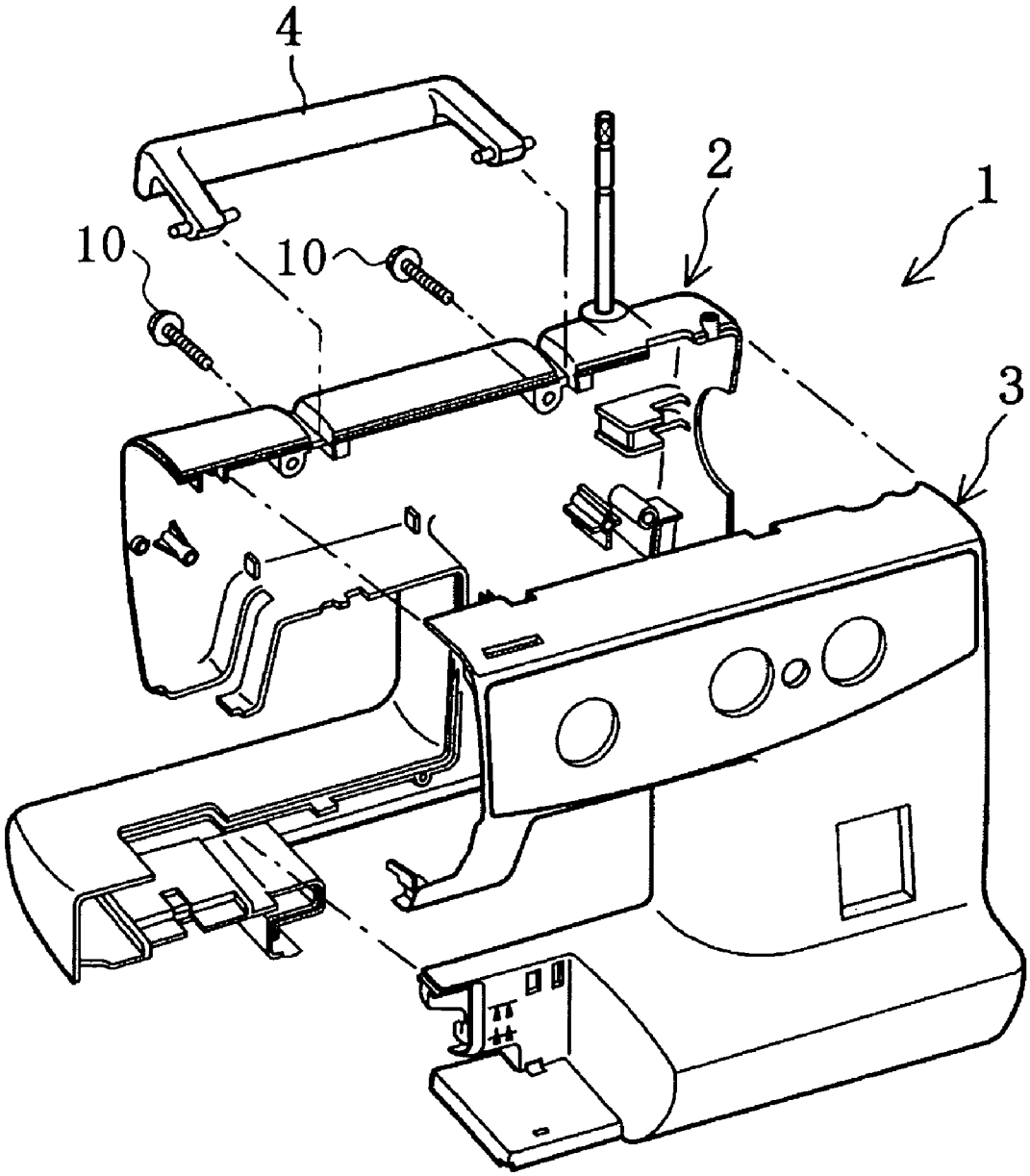
FIG. 1 is an exploded perspective view of a sewing machine cover in the handle mounting structure in accordance with an embodiment of the present invention.

Several embodiments, in which the handle mounting structure of the present invention is applied to household portable sewing machine, will be described with reference to the accompanying drawings. FIGS. 1 to 7 show a first embodiment of the invention. Referring to FIG. 1, a sewing machine cover 1 of the portable sewing machine is shown. The sewing machine cover 1 is provided for covering a sewing machine body (not shown) and includes a rear cover 2 and a front cover 3. Onto the rear cover 2 are assembled a needle bar driving mechanism, a feed driving mechanism and a shuttle driving mechanism. The rear cover 2 has an upper end on which a handle 4 is adapted to be mounted.

Figure 2:
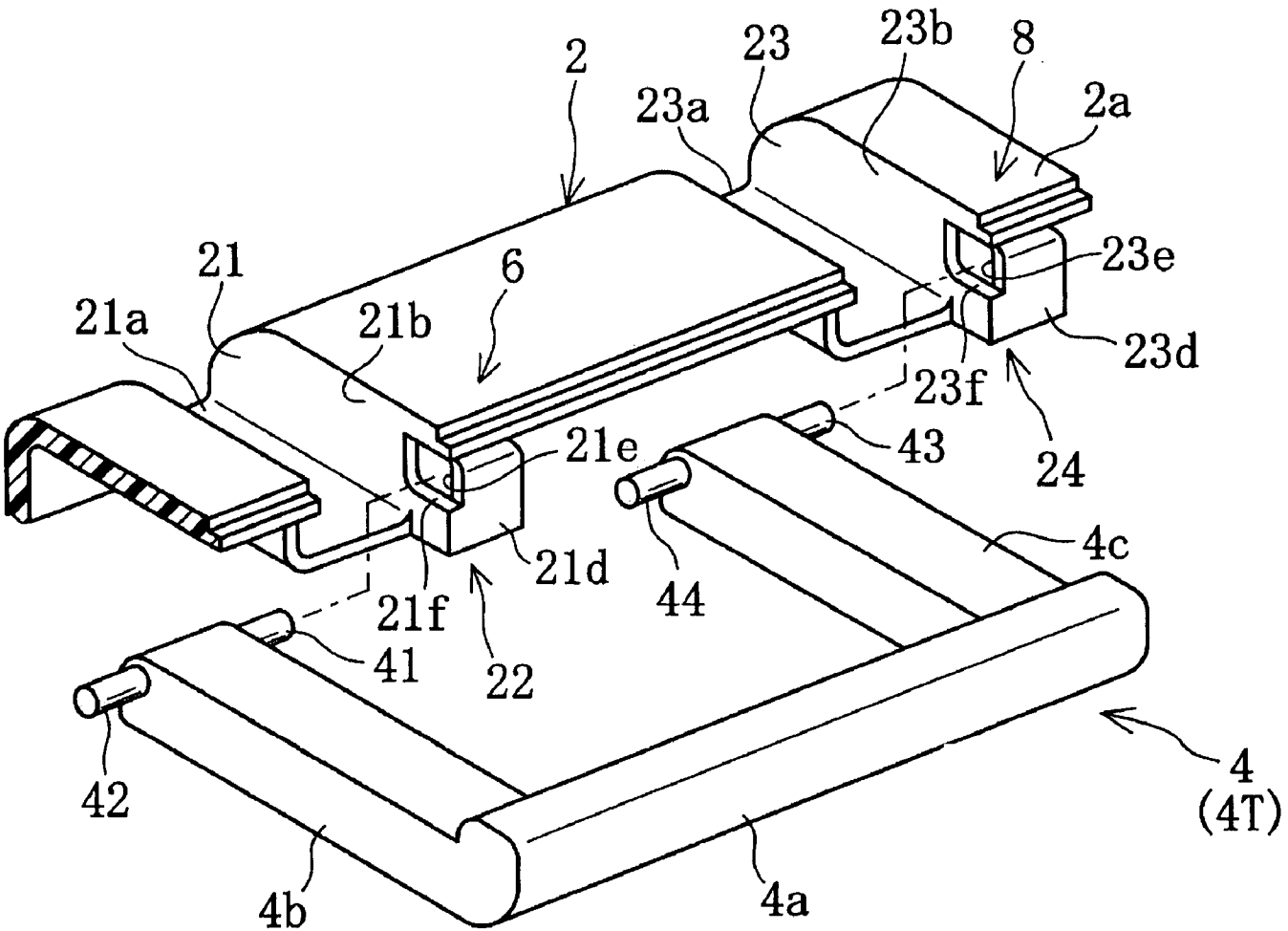
FIG. 2 is an exploded perspective view of a part of a rear cover and a handle.
Figure 4:
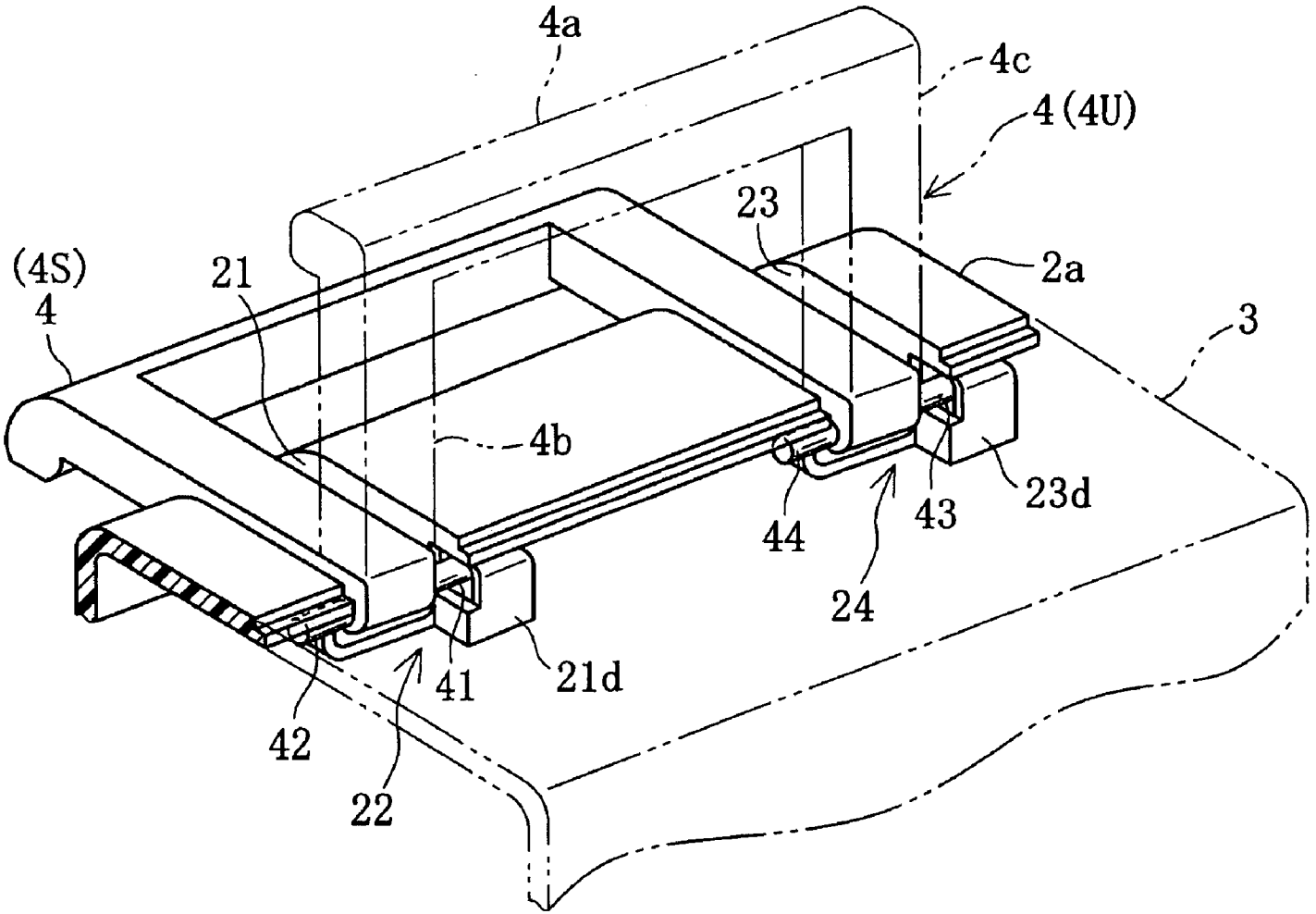
FIG. 4 is a perspective view of a part of the rear cover on which a handle has been mounted.
Figure 5:
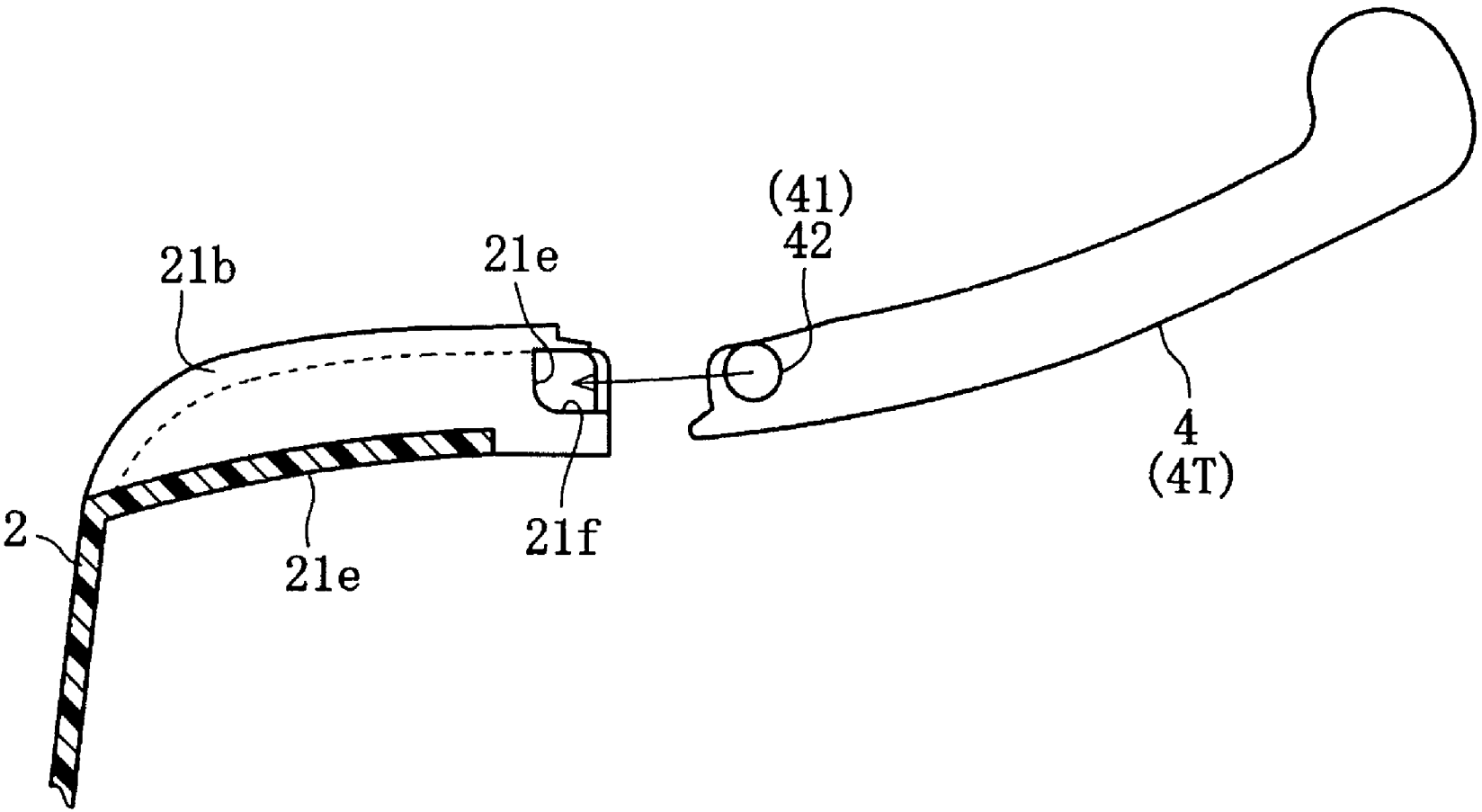
FIG. 5 is a view showing the procedure for mounting the handle on a pivot.

Referring now to FIGS. 2 and 4; the handle 4 includes a grip 4*a* and a pair of legs 4*b* and 4*c* extending from both ends of the grip 4*a*. When the handle 4 assumes a vertical position, the grip 4*a* extends horizontally and the legs 4*b* and 4*c* extend vertically, as shown by two-dot chain line in FIG. 4. The legs 4*b* and 4*c* have distal ends with engagement bosses 41 and 43 formed on right-hand portions respectively. The engagement bosses 41 and 43 serve as shaft-like members engaging engagement holes respectively. The distal ends of the legs 4*b* and 4*c* further have support bosses 42 and 44 formed on left-hand portions thereof respectively. The support bosses 42 and 44 serve as shaft-like members which are not engaged with the engagement holes. In this case, the engagement boss 41 of the left leg 4*b* is as long as the engagement boss 43 of the right leg 4*c*.

Figure 3:
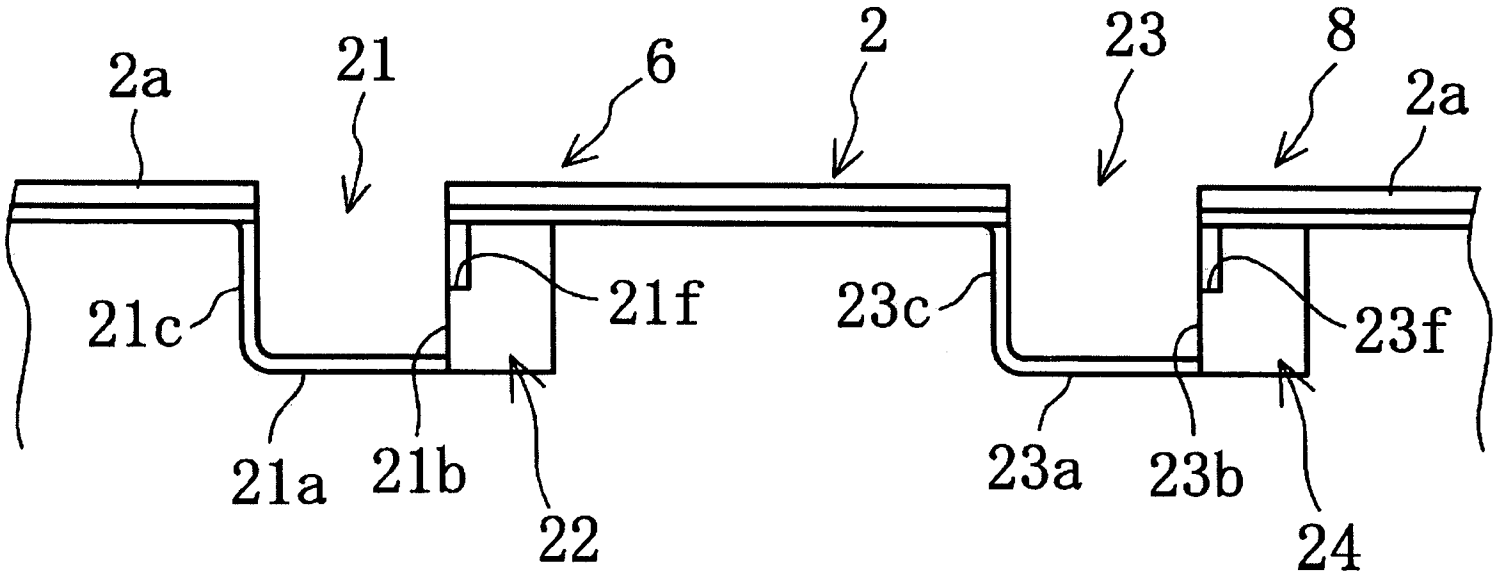
FIG. 3 is a front view of a part of the rear cover.

Referring now to FIGS. 2 and 3, the rear cover 2 has an upper end formed with a pair of accommodation grooves 21 and 23 which are spaced away from each other right and left. Each accommodation groove elongates back and forth. The legs 4*b* and 4*c* of the handle 4 are adapted to be accommodated in the accommodation grooves 21 and 23 respectively. The accommodation grooves 21 and 23 have bottoms 21*a* and 23*a*, right side walls 21*b* and 23*b* and left walls 21*c* and 23*c* respectively. Front ends of the bottoms 21*a* and 23*a* and left walls 21*c* and 23*c* are cut out.

Mounting structures 6 and 8 for the handle 4 are provided on the right of the accommodation grooves 21 and 23 respectively. The mounting structures 6 and 8 are constructed as follows. The right side wall 21*b* of the accommodation groove 21 has a front end formed with a front wall 21*d* with a predetermined width. The front wall 21*d* is formed integrally with the rear cover 2. The front wall 21*d* has an upper end continuous to a top 2*a* of the rear cover 2. A pivot 22 is constituted by a front end of the right side wall 21*b*, front wall 21*d* and the like. Thus, the pivot 22 is located at a portion of the rear cover 2 to which the front cover 3 is joined.

The front end of the right side wall 21*b* has a generally rectangular engagement hole 21*e* which is formed therethrough and with which the engagement boss 41 is engageable. Furthermore, a part of a left end of the front wall 21*d* corresponding to the engagement hole 21*e* is cut out by a dimension corresponding to a thickness of the right side wall 21*b* as viewed in FIG. 2. As a result, the engagement hole 21*e* is defined by a peripheral face which is formed into a generally U-shaped opening and has an open front. The U-shaped peripheral face is referred to as "abutment face 21*f*."

Figure 7:
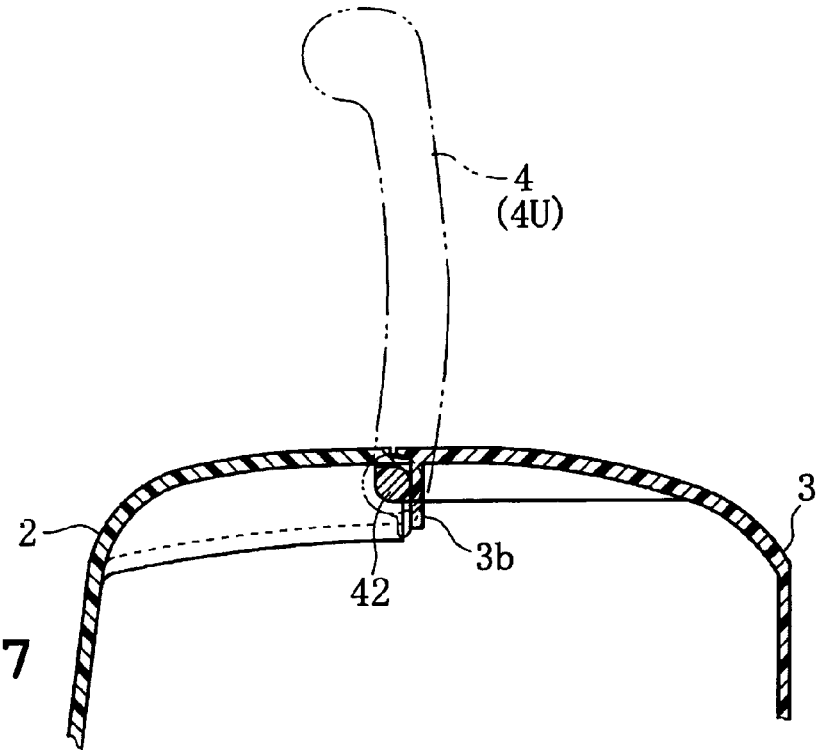
FIG. 7 is a longitudinal side section showing the positional relation between a limiting wall and a supporting boss.

The right mounting structure 8 also has a front wall 23*d* provided on the front of a right side wall 23*b* of an accommodation groove 23, an engagement hole 23*e* and an abutment face 23*f* both provided in a front end of the right side wall 23*b* and a pivot 24 as the left mounting structure 6 has. On the other hand, the front cover 3 includes an upper wall 3*a* further including limiting walls 3*b* located just in front of the supporting bosses 42 and 44 of the handle 4 respectively, as shown in FIG. 7.

The following describes the work for mounting the handle 4 on the above-described mounting structures 6 and 8. Firstly, the handle 4 is set in a mounting position (serving as a predetermined position) in which the grip 4*a* has been brought down such that the grip 4*a* is positioned at the front of the sewing machine cover 1 (see FIGS. 2 and 5). Subsequently, the distal ends of the legs 4*b* and 4*c* are caused to approach to the front ends of the accommodation grooves 21 and 23 from below while the handle 4 is held in the position 4T. Thereafter, the handle 4 is slid rightward or in the direction of protrusion of the engagement bosses 41 and 43. The distal or right-hand ends of the engagement bosses 41 and 43 are abutted against the abutment face 21*f* to be positioned. Subsequently, the engagement bosses 41 and 43 are pushed into inner parts of the engagement holes 21*e* and 23*e* respectively, whereby the engagement bosses 41 and 43 engage the respective engagement holes 21*e* and 23*e*. Thus, the handle 4 is mounted on the rear cover 2.

The legs 4*b* and 4*c* of the handle 4 are located at front ends of the accommodation grooves 21 and 23 respectively and the support bosses 42 and 44 are in abutment with the underside of the upper wall 2*a*. As a result, the handle 4 can pivot about the engagement bosses 41 and 43. More specifically, the handle 4 assuming the position 4T is caused to pivot so that the handle can be switched to an accommodation position 4S as shown by solid line and a use position 4U as shown by two-dot chain line in FIGS. 4 and 6. When the handle 4 assumes the accommodation position 4S, the legs 4*b* and 4*c* are accommodated in the accommodation grooves 21 and 23 respectively. When the handle 4 assumes the use position 4U, the legs 4*b* and 4*c* stand upright. The handle 4 assuming the accommodation position 4S is caused to pivot about 180 degrees thereby to assume the mounting position 4T.

Figure 6:
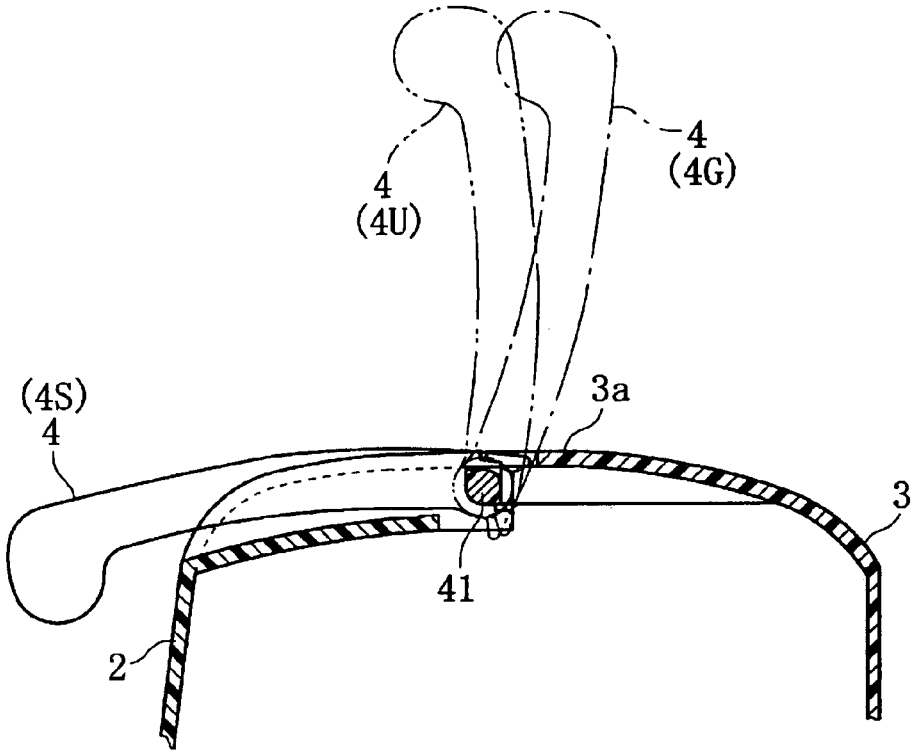
FIG. 6 is a longitudinal side section showing the relationship between an accommodation groove and the handle.

After the handle 4 has been mounted on the rear cover 2, the front cover 3 is placed in front of the rear cover 2 and then assembled to the rear cover 2 by a plurality of fixing screws 10 (see FIG. 1) as shown in FIG. 6. Thus, the mounting of the handle 4 and the assembling of the rear and front covers 2 and 3 are completed.

In the foregoing embodiment, the handle 4 is mounted to the rear cover 2 before the front cover 3 is assembled to the rear cover 2. Moreover, the handle 4 is slid in the direction of protrusion of the engagement bosses 41 and 43 so that the engagement bosses 41 and 43 can be engaged with the engagement holes 21*e* and 23*e* respectively. Consequently, the handle 4 can easily be mounted on the pivots 22 and 24. Additionally, the assembling work can be simplified since the front cover 3 is assembled to the rear cover 2 while the handle 4 is held on the rear cover 2 in the mounted state.

When the front cover 3 has been assembled to the rear cover 2, the limiting walls 3*b* formed on the underside of the front cover 3 and located in front of the support bosses 42 and 44 abut against the support bosses 42 and 44 respectively, as shown in FIG. 7. As a result, even if the user holds the grip 4*a* in such a manner as to twist the handle 4 relative to the sewing machine, the limiting walls 3*b* limit the forward movement of the support bosses 42 and 44. Consequently, the position of the handle 4 which has been mounted on the rear cover 2 can be rendered stable.

Furthermore, when the front cover 3 has been assembled to the rear cover 2, the legs 4*b* and 4*c* abut against the rear end of the top 3*a* of the front cover 3, whereby forward pivot of the handle 4 is limited, as shown in FIG. 6. Accordingly, the handle 4 cannot pivot beyond the limit forward position 4G as shown by chain line in FIG. 6. In other words, the handle 4 can pivot in the range from the accommodation position 4S to the limit forward position 4G but cannot assume the mounting position 4T.

The engagement bosses 41 and 43 are in engagement with the engagement holes 21*e* and 23*e* respectively when the handle 4 assumes any position in the range from the accommodation position 4S to the limit forward position 4G. Moreover, parts of the right and left side walls of the legs 4*b* and 4*c* are held between the right side walls 21*b* and 23*b* and left side walls 21*c* and 23*c* of the accommodation grooves 21 and 23. Accordingly, since movement of both legs 4*b* and 4*c* in the direction of axes of the engagement bosses 41 and 43 is limited, whereupon the handle 4 is prevented from being detached from the rear cover 2. Thus, in the foregoing embodiment, the right side walls 21*b* and 23*b* and left side walls 21*c* and 23*c* of the accommodation grooves 21 and 23 correspond to limiting sections respectively. Accordingly, the handle 4 can reliably be prevented from falling off from the covers 2 and 3 even when the handle 4 has just been assembled onto the rear cover 2 but the front cover has not been assembled onto the rear cover 2 yet. Furthermore, since no extra components are used for the mounting of the handle 4 on the rear cover 2, the production cost can be reduced and the mounting efficiency can be improved to a large extent.

Figure 8:
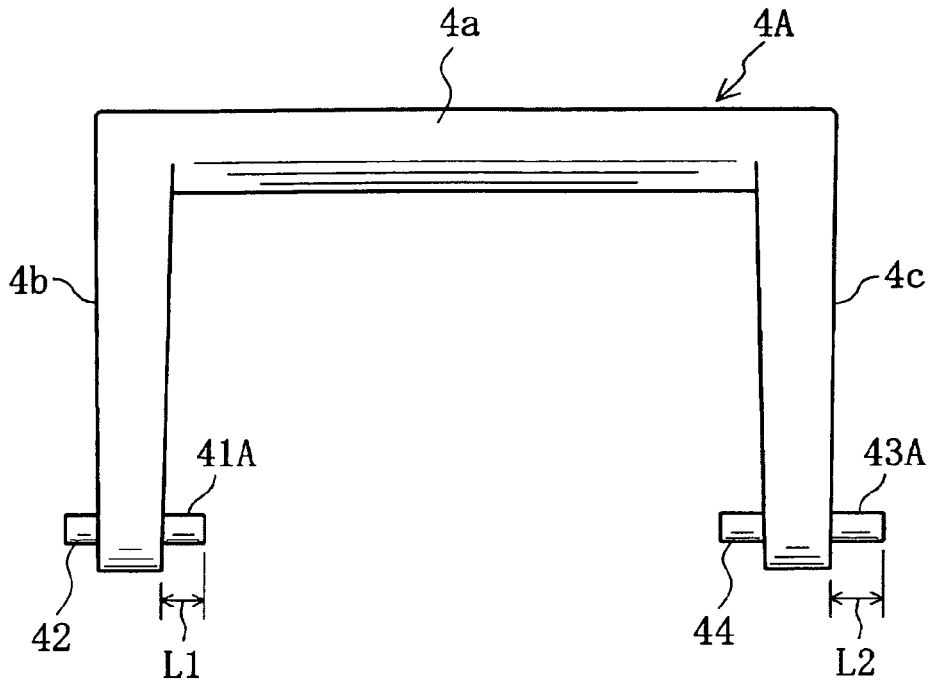
FIG. 8 is a front view of the handle employed in the mounting structure in accordance with a second embodiment of the invention.

FIG. 8 illustrates a second embodiment of the invention. Only the difference of the second embodiment from the first embodiment will be described. Identical or similar parts in the second embodiment are labeled by the same reference symbols as those in the first embodiment and the description of these identical or similar parts will be eliminated.

The handle 4A in the second embodiment includes the legs 4*b* and 4*c* and the engagement bosses 41A and 43A formed on the distal ends of the legs 4*b* and 4*c*. The handle 4A is further formed with the support bosses 42 and 44. The axial dimension L2 of the engagement boss 43A is set to be larger than the axial dimension L1 of the engagement boss 41A.

In the above-described construction, a part of the longer engagement boss 43A is first engaged with the engagement hole 23*e* and subsequently, the shorter engagement boss 41A is engaged with the engagement hole 21*e*. Consequently, the efficiency in the mounting of the handle 4 can be improved. The other construction of the second embodiment is the same as the first embodiment. Accordingly, the second embodiment can accomplish the same effect as the first embodiment.

Figure 9:
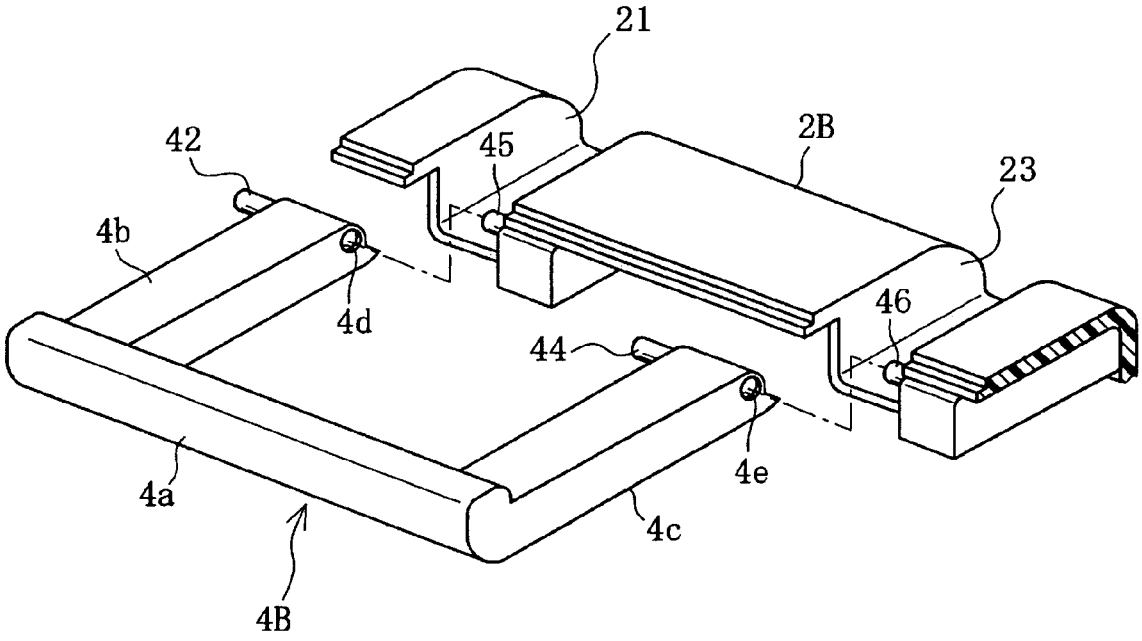
FIG. 9 is a view similar to FIG. 2, showing a third embodiment of the invention.

FIG. 9 illustrates a third embodiment of the invention. Only the difference of the third embodiment from the first embodiment will be described. Identical or similar parts in the third embodiment are labeled by the same reference symbols as those in the first embodiment.

The handle 4B in the third embodiment includes the legs 4*b* and 4*c* and the engagement holes 4*d* and 4*e* formed in the distal ends of the legs 4*b* and 4*c*. The handle 4B is further formed with the support bosses 42 and 44. Furthermore, the paired engagement bosses 45 and 46 are formed on the right side walls 21*b* and 23*b* of the accommodation grooves 21 and 23 of the rear cover 2B respectively. The engagement bosses 45 and 46 are adapted to engage the engagement holes 4*d* and 4*e* respectively.

In the above-described construction, the handle 4B assuming the predetermined position 4T is slid toward the engagement bosses 45 and 46 before the front cover 3 is mounted on the rear cover 2B, whereupon the engagement holes 4*d* and 4*e* are engaged with the engagement bosses 45 and 46 respectively. As a result, the handle 4B is mounted on the rear cover 2B. The other construction of the third embodiment is the same as the first embodiment. Accordingly, the third embodiment can accomplish the same effect as the first embodiment.

Figure 10:
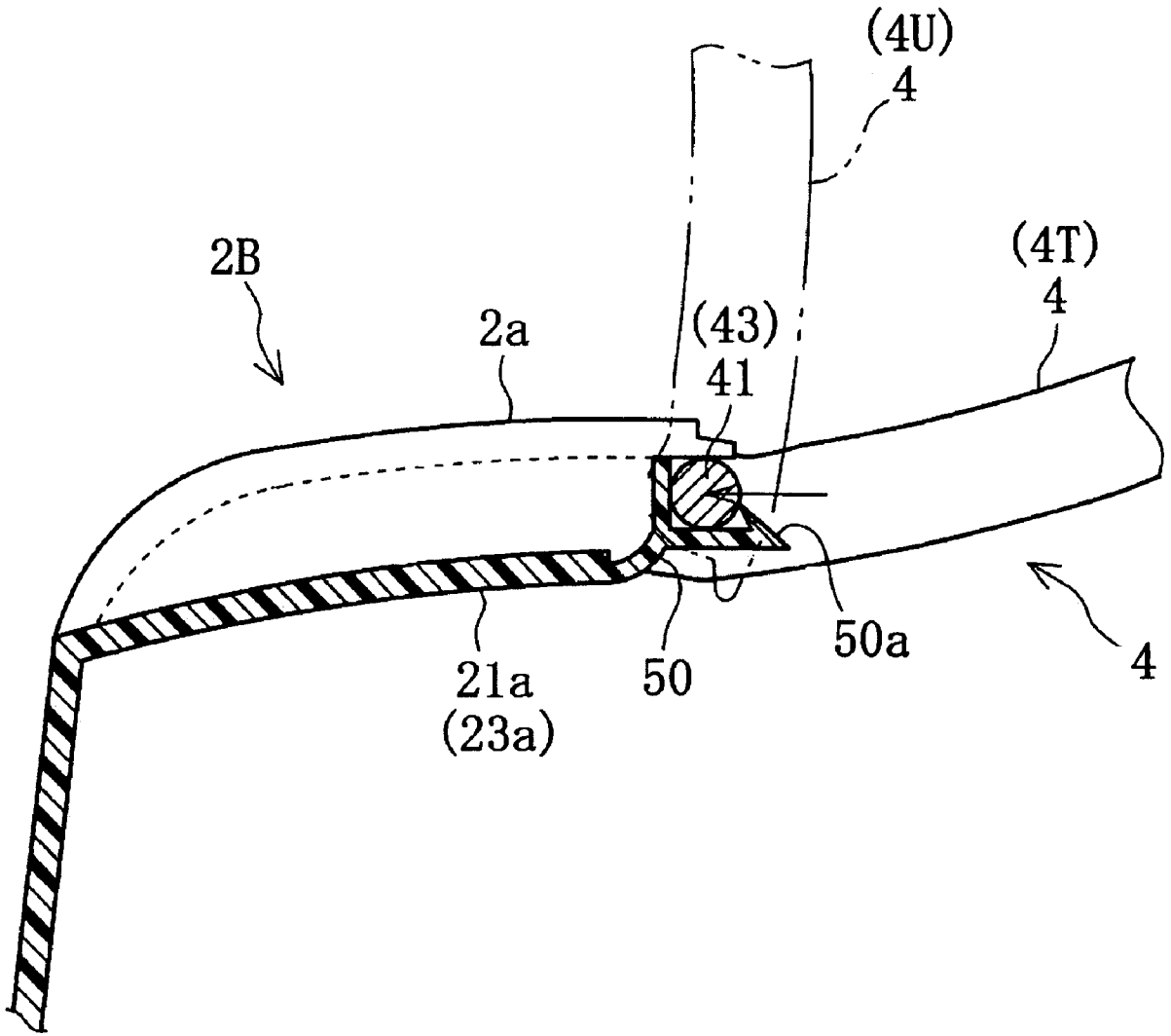
FIG. 10 is a longitudinal side section of a part of the rear cover in a fourth embodiment of the invention.

FIG. 10 illustrates a fourth embodiment of the invention. Only the difference of the fourth embodiment from the first embodiment will be described. Identical or similar parts in the fourth embodiment are labeled by the same reference symbols as those in the first embodiment.

The fourth embodiment differs from the first embodiment in the construction of the pivots 22 and 24. More specifically, the accommodation grooves 21 and 23 have elastically deformable engagement pieces 50 formed integrally on the front ends of the bottoms 21*a* and 23*a* respectively. Each engagement piece 50 includes a front portion having a forwardly protruding upward hook 50*a* integrally formed thereon.

In the above-described construction, the engagement bosses 41 and 43 are disposed between the top 2*a* of the rear cover 2B and the hooks 50*a* and the handle 4 is pushed rearward. Then, the engagement pieces 50 are elastically deformed such that the engagement bosses 41 and 43 are fitted into spaces between the top 2*a* and the hooks 50*a*. In this case, the engagement bosses 41 and 43 can be fitted into the spaces between the top 2*a* and the hooks 50*a* even when the handle 4 assumes the position other than the mounting position 4T, for example, the use position 4U. Furthermore, the engagement bosses 41 and 43, when fitted into the spaces between the top 2*a* and the hooks 50*a*, cannot be detached easily.

The invention should not be limited to the foregoing embodiments and may be modified as follows. The handle may be mounted on the front cover of the sewing machine, instead.

Furthermore, the invention may be applied to any mounting structure for a handle which is mounted on a casing formed by coupling two cover members. In this case, the mounting structure comprises a handle including a grip, a pair of legs extending from the grip and shaft-like members formed on the distal ends of the legs respectively. The mounting structure further comprises a pair of pivots provided on either first or second cover. Each pivot has an engagement hole with which the engagement boss is engageable by sliding the handle in the direction of protrusion of the boss before either one of the first and second covers is mounted on the other.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

I claim:

1. A handle mounting structure for a sewing machine including a sewing machine body, a front cover covering the sewing machine body and a rear cover, the structure comprising:

a handle including a grip having both ends provided with a pair of legs having distal ends respectively, and two pairs of shaft-like members provided on the distal ends of the legs; and a pair of pivots provided on either the front cover or the rear cover for supporting the legs respectively, the pivots having engagement holes to which corresponding pair of shaft-like members of each leg engages, the handle being slid in a projecting direction of said shaft-like members before one of the front cover and the rear cover is mounted to the other of the front cover and the rear cover so that said shaft-like members are engageable with the engagement holes.

2. The handle mounting structure of claim 1, wherein the pivots are provided on a portion of said one cover to which said other cover is joined.

3. The handle mounting structure of claim 1, wherein the handle is turnable about said shaft-like members when said each shaft-like member is in engagement with an engagement hole.

4. The handle mounting structure of claim 3, wherein said one shaft-like member is engageable with and disengageable from the engagement hole only when the handle is in a predetermined position.

5. The handle mounting structure of claim 4, wherein said one cover is provided with a pair of accommodating grooves capable of accommodating said pair of legs of the handle.

6. The handle mounting structure of claim 5, wherein the predetermined position is obtained by turning the handle about 180 degrees when the pair of legs are accommodated in the accommodating groove.

7. The handle mounting structure of claim 4, wherein said one cover includes a limiting section limiting an axial movement of the handle with respect to the shaft-like member when the handle assumes a position other than the predetermined position.

8. The handle mounting structure of claim 5, wherein the pair of pivots are provided on ends of the pair of accommodating grooves at side where said other cover is located.

9. The handle mounting structure of claim 1, wherein said other cover includes a limiting wall limiting an axial movement of the handle with respect to the shaft-like members when said other cover has been mounted on said one cover.

10. The handle mounting structure of claim 1, wherein when one shaft-like member is in engagement with an engagement hole, an other shaft-like member is in abutment with an upper part of an inner face of either the front cover or the rear cover.

11. The handle mounting structure of claim 1, wherein the pair of pivots are formed with abutment surfaces against which said shaft-like member abut before engagement with the engagement hole respectively.

12. The handle mounting structure of claim 1, wherein one shaft-like member formed on said of the pair of legs has an axial dimension differing from an axial dimension of one shaft-like member formed on said other leg.

13. The handle mounting structure of claim 4, wherein the legs abut against said other cover, whereby the handle is prevented from being turned to said cover over the limit position when said other cover has been mounted on said one cover.

14. The handle mounting structure of claim 1, wherein at least one of a needle bar driving mechanism, a feed driving mechanism and a shuttle driving mechanism is assembled to said one cover.

15. A handle mounting structure for a sewing machine including a sewing machine body, a front cover covering the sewing machine body and a rear cover, the structure comprising:

a handle including a grip having both ends provided with a pair of legs having distal ends respectively and two engagement holes formed in the distal ends of the legs respectively; and a pair of shaft-like members provided on either the front cover or the rear cover, wherein the handle is slid toward the shaft-like members before one of the front cover or the rear cover is mounted to the other of the from cover and the rear cover, the engagement holes are engageable with the shaft-like members respectively.

16. A handle mounting structure of claim 15, wherein the handle is turnable about either of the pair of shaft-like members when the engagement holes are in engagement with the shaft-like members respectively.

17. The handle mounting structure of claim 16, wherein one of said shaft-like members is engageable with and disengageable from one of the engagement holes only when the handle is in a predetermined position.

18. The handle mounting structure of claim 17, wherein one of the front cover and the rear cover is provided with a pair of accommodating grooves capable of accommodating said pair of legs of the handle.

19. The handle mounting structure of claim 18, wherein the predetermined position is obtained by turning the handle about 180 degrees when the pair of legs are accommodated in the accommodating groove.

20. The handle mounting structure of claim 17, wherein said one of the front cover and the rear cover includes a limiting section limiting an axial movement of the handle with respect to the shaft-like member when the handle assumes a position other than the predetermined position.

21. A handle mounting structure for a sewing machine including a sewing machine body, a front cover covering the sewing machine body and a rear cover, the structure comprising:

a handle including a grip having both ends provided with a pair of legs having distal ends respectively, and two pairs of shaft-like members provided on the distal ends of the legs; and a pair of elastically deformable engagement pieces a corresponding one of the shaft-like members of each leg engages, wherein the handle is thrust toward the engagement pieces before said other cover is mounted on said one cover so that said one shaft-like member is engageable with one pair of engagement pieces.

22. The handle mounting structure of claim 21, wherein said one cover is provided with a pair of accommodating grooves capable of accommodating said pair of legs of the handle.

23. The handle mounting structure of claim 21, wherein the legs abut against said other cover when said other cover has been mounted on said one cover, whereby a turn of the handle toward said other cover over a limit position is limited.

24. The handle mounting structure of claim 21, wherein at least one of a needle bar driving mechanism, a feed driving mechanism and a shuttle driving mechanism is assembled to said one cover.

25. A handle mounting structure for a casing including two covers connected to each other, comprising:

a handle including a grip having both ends, a pair of legs provided on the ends of the grip respectively and having distal ends respectively, and two pairs of shaft-like members provided on the distal ends of the legs respectively; and a pair of pivots provided on either cover for supporting the legs respectively, the pivots having engagement holes corresponding to one of the pair of shaft-like members of which each leg engages, the handle being slid in a projecting direction of said shaft-like members before one of a first cover and a second cover is mounted to the other of the first and the second covers so that said one of the pair of shaft-like members is engageable with an engagement holes.

26. The handle mounting structure of claim 25, wherein the handle is turnable about said pair of shaft-like members when said one of the pair of shaft-like members is in engagement with the engagement hole.

27. The handle mounting structure of claim 26, wherein said one of the pair of shaft-like members is engageable with and disengageable from the engagement hole only when the handle is in a predetermined position.

28. The handle mounting structure of claim 27, wherein one of said first and second cover is provided with a pair of accommodating grooves capable of accommodating said pair of legs of the handle.

29. The handle mounting structure of claim 28, wherein the predetermined position is obtained by turning the handle about 180 degrees when the pair of legs are accommodated in the accommodating grooves.

30. The handle mounting structure of claim 27, wherein said one cover includes a limiting section limiting an axial movement of the handle with respect to the shaft-like member when the handle assumes a position other than the predetermined position.

* * * * *